US007066542B2

(12) United States Patent
Wang

(10) Patent No.: US 7,066,542 B2
(45) Date of Patent: Jun. 27, 2006

(54) CHILD HIGH CHAIR WITH AN INCLINATION ADJUSTABLE BACKREST

(75) Inventor: Chih-Wei Wang, Taipei (TW)

(73) Assignee: Adora Business Co., Ltd., Tortola (VG)

( * ) Notice: Subject to any disclaimer, the term of this patent is extended or adjusted under 35 U.S.C. 154(b) by 0 days.

(21) Appl. No.: 11/060,512

(22) Filed: Feb. 17, 2005

(65) Prior Publication Data

US 2005/0248186 A1 Nov. 10, 2005

(30) Foreign Application Priority Data

Mar. 16, 2004 (CN) ..... 2004 2 0007130

(51) Int. Cl.
*A47D 1/02* (2006.01)

(52) U.S. Cl. ..... 297/376; 297/364; 297/151

(58) Field of Classification Search ..... 297/148, 297/149, 151, 153, 376, 374, 362.12, 363, 297/364, 354.1, 354.12, 354.13, 361.1
See application file for complete search history.

(56) References Cited

U.S. PATENT DOCUMENTS 4,762,364 A * 8/1988 Young ..... 297/256.12
4,938,603 A 7/1990 Turner et al. ..... 297/16
5,669,664 A * 9/1997 Perego ..... 297/327
5,810,432 A 9/1998 Haut et al. ..... 297/153
5,823,615 A * 10/1998 Haut ..... 297/151
6,419,312 B1 * 7/2002 Flannery et al. ..... 297/149
2005/0029852 A1 * 2/2005 Chen ..... 297/354.12
2005/0127722 A1 * 6/2005 Longnecker et al. ..... 297/148

FOREIGN PATENT DOCUMENTS

GB 2 358 793 A 8/2001
GB 2 375 956 A 12/2002

OTHER PUBLICATIONS

Search Report dated Sep. 2, 2004 from GB0411886.5 (3 pgs).

* cited by examiner

*Primary Examiner*—Milton Nelson, Jr.
(74) *Attorney, Agent, or Firm*—DLA Piper Rudnick Gray Cary US LLP

(57) ABSTRACT

A child high chair includes a seat body disposed between two side guarding members on an upper portion of a support leg, a backrest unit having two lateral ends pivotally coupled to the side guarding members to be turnable relative thereto, two bolts disposed movably on the lateral ends in a longitudinal direction, an actuator movably disposed on the backrest unit in an upright direction, and two flexible members interconnecting the actuator and the bolts such that when the actuator is moved from a lower position to an upper position, the flexible members are pulled to move the bolts in the longitudinal direction from an extended position where the bolts engage retaining members on the side guarding members to a retracted position where the bolts disengage from the retaining members so as to permit turning of the backrest unit relative to the seat body.

7 Claims, 9 Drawing Sheets

CHILD HIGH CHAIR WITH AN INCLINATION ADJUSTABLE BACKREST

CROSS-REFERENCE TO RELATED APPLICATION

This application claims priority of Chinese patent Application No. 200420007130.X, filed on Mar. 16, 2004.

BACKGROUND OF THE INVENTION

1. Field of the Invention

This invention relates to a child high chair, more particularly to a child high chair with a backrest unit which is adjustably retained relative to a seat body.

2. Description of the Related Art

An example of a foldable high chair is disclosed in U.S. Pat. No. 4,938,603, and includes a lock-release mechanism which is mounted on a back thereof to control relative movement between a chair back and an underlying seat and leg assembly. The lock-release mechanism can be actuated manually to permit the high chair to be folded from an unfolded use position to a partly folded safety stop position and a fully folded storage position. The lock-release mechanism has a transmitting device to transmit an upward pulling force by the user to unlock lateral locking devices which are disposed to lock the chair back relative to the seat. However, the transmitting device has a large number of components, thereby resulting in higher manufacturing costs and a higher breakdown probability.

SUMMARY OF THE INVENTION

The object of the present invention is to provide a child high chair with a releasably retaining unit which can be operated easily and which has a simple construction to releasably retain a backrest unit at a desired inclination angle relative to a seat body.

According to this invention, the child high chair comprises a support leg having a lower portion for supporting the child high chair on the ground, and an upper portion opposite to the lower portion in an upright direction. A mounting seat includes left and right side guarding members which are opposite to each other in a longitudinal direction transverse to the upright direction and which are secured on the upper portion of the support leg. A seat body is disposed between the left and right side guarding members, and has front and rear seat portions opposite to each other in a transverse direction relative to both the longitudinal direction and the upright direction. A backrest unit has left and right lateral ends which are opposite to each other in the longitudinal direction, and which are respectively inboard to the left and right side guarding members, and a middle backrest portion which is disposed between the left and right lateral ends and which has front and rear walls opposite to each other in the transverse direction. Each of the left and right lateral ends is pivotally coupled to a respective one of the left and right side guarding members adjacent to the rear seat portion of the seat body to permit the backrest unit to turn about a pivot axis in the longitudinal direction. A plurality of left retaining members are disposed on the left guarding member, and are angularly displaced from one another about the pivot axis. A plurality of right retaining members are disposed on the right side guarding member, and are angularly displaced from one another about the pivot axis. A pair of bolts are disposed on the left and right lateral ends, respectively. Each of the bolts is movable relative to a respective one of the left and right lateral ends in the longitudinal direction between an extended position, where a respective one of the bolts engages a selected one of the left and right retaining members so as to prevent turning of the backrest unit, and a retracted position, where the respective one of the bolts disengages from any one of the left and right retaining members so as to permit turning of the backrest unit about the pivot axis. An actuator is disposed on and is movable relative to the rear wall of the middle backrest portion in the upright direction. A pair of flexible members have first ends connected to the actuator, and second ends connected to the bolts, respectively. The flexible members are configured such that when the actuator is moved in the upright direction from a lower position to an upper position, the flexible members are pulled to move the bolts in the longitudinal direction from the extended position to the retracted position. A biasing member is disposed to bias the actuator toward the lower position.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
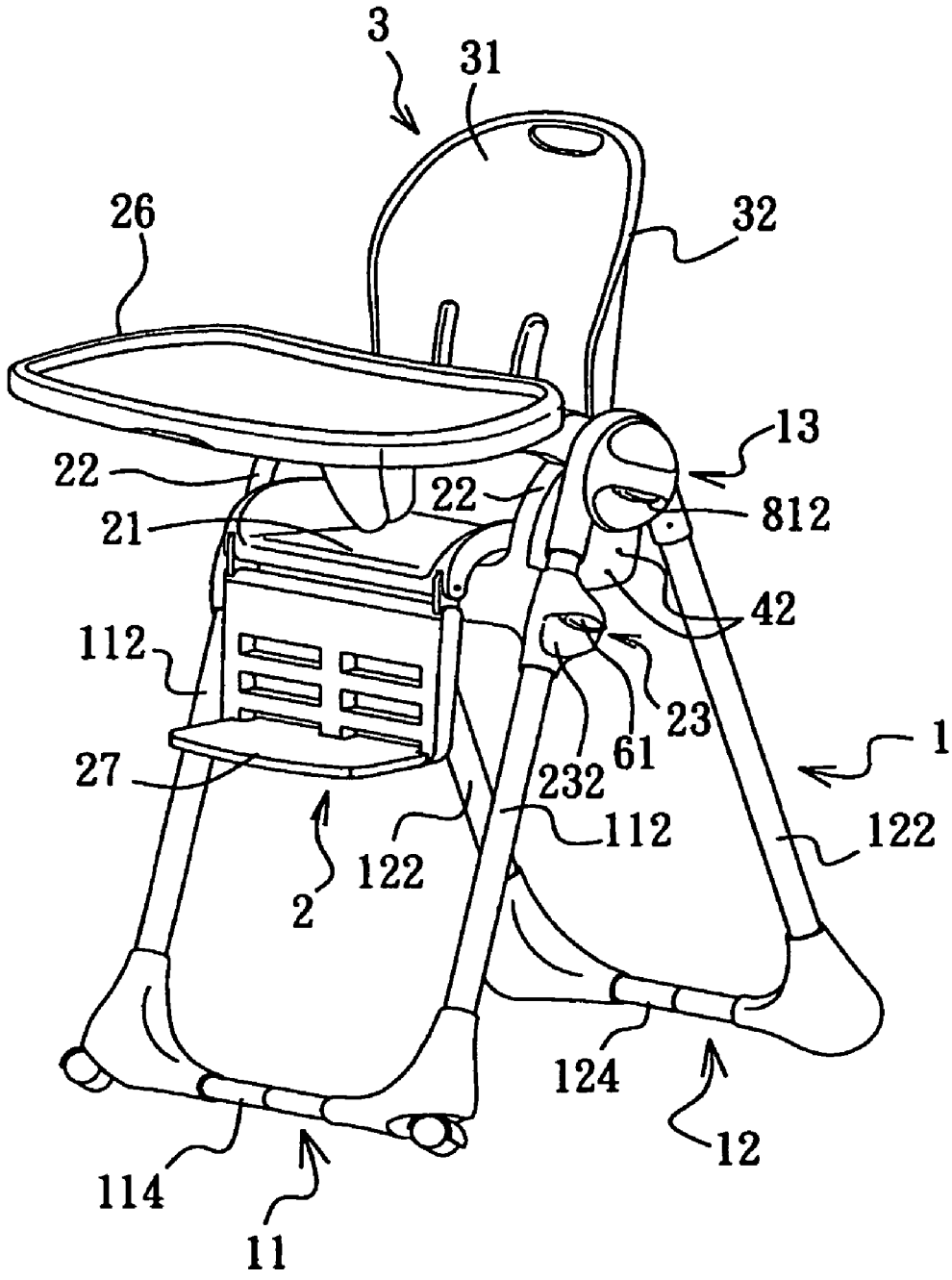
FIG. 1 is a perspective view of the preferred embodiment of a child high chair according to this invention when unfolded.
Figure 2:
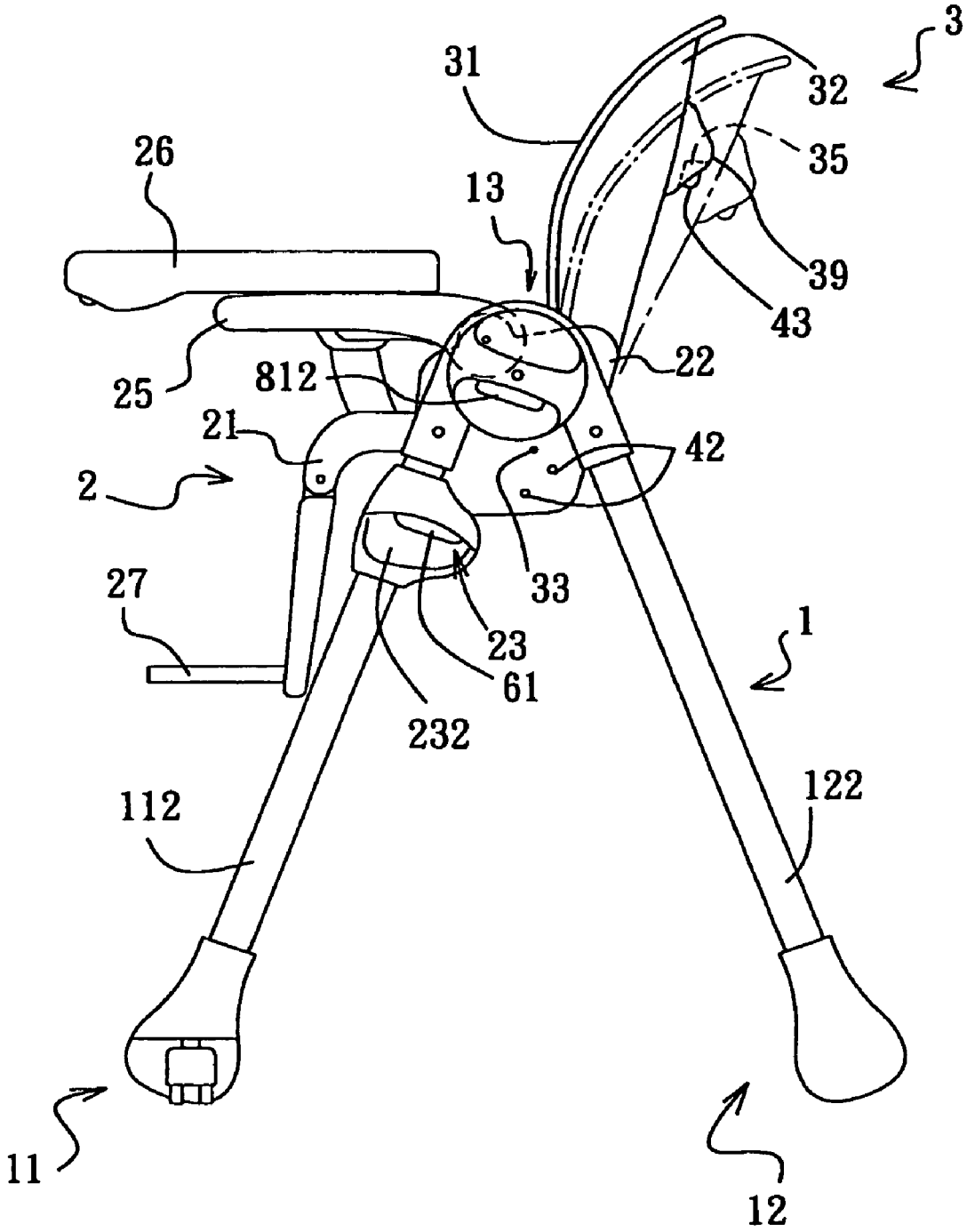
FIG. 2 is a side view of the preferred embodiment when unfolded.
Figure 3:
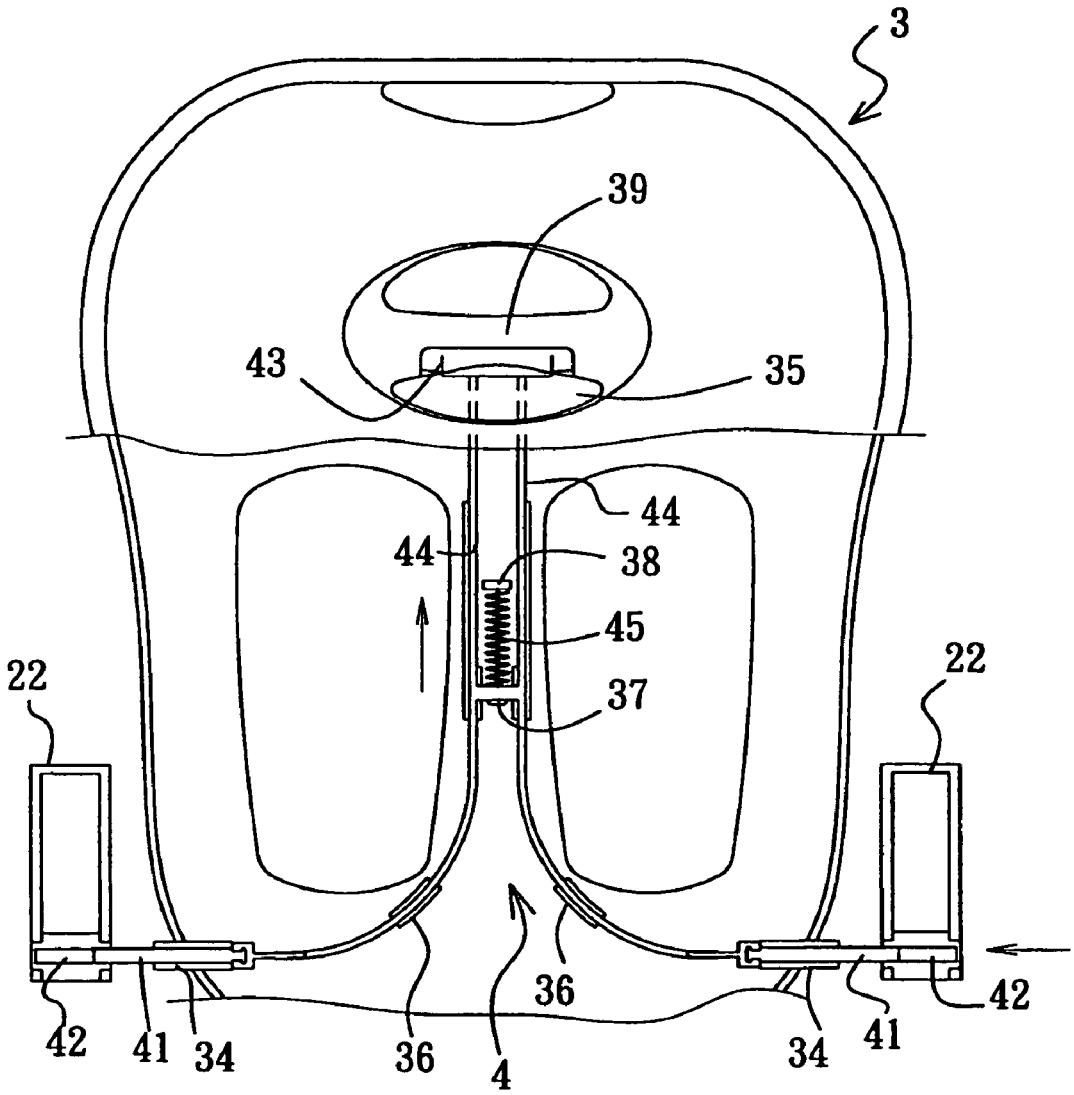
FIG. 3 is a fragmentary rear view showing a part of a backrest unit of the preferred embodiment.

Referring to FIGS. 1 to 3, the preferred embodiment of a child high chair according to the present invention is shown to comprise a support leg 1, a seat unit 2, and a backrest unit 3.

The support leg 1 includes front and rear leg frames 11,12, each of which includes a pair of upright segments 112,122 and a lower transverse segment 114,124 interconnecting lower portions of the upright segments 112,122 for supporting on the ground. The upright segments 112,122 of each of the front and rear leg frames 11,12 have upper portions extending from the lower portions in an upright direction. Each of the upper portions of the front leg frame 11 is coupled with the corresponding upper portion of the rear leg frame 12 by a coupler 13.

The seat unit 2 includes a mounting seat which includes left and right side guarding members 22 opposite to each other in a longitudinal direction transverse to the upright direction, and left and right secured members 23 that are respectively disposed under the left and right side guarding members 22, and that are respectively connected to the upper portions of the front leg frame 11, a seat body 21 which is disposed between the left and right side guarding members 22, left and right armrests 25 which are coupled with upper ends of the left and right side guarding members 22, a tray 26 which is slidably disposed on the left and right armrests 25, and an L-shaped footrest 27 which is connected to front seat portion of the seat body 21.

The backrest unit 3 includes front and rear halves 31,32 opposite to each other in a transverse direction relative to both the upright direction and the longitudinal direction to define an accommodation chamber therebetween. The backrest unit 3 has left and right lateral ends which are opposite to each other in the longitudinal direction and which are respectively inboard to the left and right side guarding members 22, and a middle backrest portion which is disposed between the left and right lateral ends and which has front and rear walls on the front and rear halves 31,32, respectively. The rear wall of the middle backrest portion has inner and outer surfaces opposite to each other in the transverse direction, and a passage 35 which extends from the inner surface through the outer surface. The left and right lateral ends are pivotally coupled to the left and right side guarding members 22 adjacent to a rear seat portion of the seat body 21 to permit the backrest unit 3 to turn about a pivot axis 33 in the longitudinal direction so that an inclination angle of the backrest unit 3 relative to the seat body 21 is adjustable.

To retain the backrest unit 3 at a desired inclination angle, a releasably retaining unit 4 is provided in the accommodation chamber in the backrest unit 3, and includes a plurality of left and right retaining members 42, left and right bolts 41, an actuator 43, left and right flexible members 44, left and right stabilizing members 36, and a biasing member 45.

The left retaining members 42 are in the form of holes 42 which are formed in the left side guarding member 22 and which are angularly displaced from one another about the pivot axis 33. The right retaining members 42 are in the form of holes 42 which are formed in the right side guarding member 22 and which are angularly displaced from one another about the pivot axis 33. The left and right bolts 41 are disposed on the left and right lateral ends of the backrest unit 3, and are guided by rails 34 that are mounted on an inner surface of the rear half 32 of the backrest unit 3 to be moved relative to the left and right lateral ends of the backrest unit 3, respectively, in the longitudinal direction, between an extended position, where the left and right bolts 41 are inserted into two selected ones of the holes 42 so as to prevent turning of the backrest unit 3, and a retracted position, where each of the left and right bolts 41 disengages from any one of the holes 42 so as to permit turning of the backrest unit 3 about the pivot axis 33.

Each of the left and right flexible members 44 is disposed on the inner surface of the middle backrest portion, and is in the form of a flexible cord 44 which is made from a flexible plastic material, and which has a first end that extends outwardly through the passage 35 to be connected to the actuator 43, a second end connected to a respective one of the left and right bolts 41, and a middle portion between the first and second ends. As such, when the actuator 43 is pulled in the upright direction from a lower position to an upper position, the flexible cords 44 are pulled to move the bolts 41 in the longitudinal direction from the extended position to the retracted position.

Each of the left and right stabilizing members 36 is in the form of a curved rail 36 which is mounted on the inner surface of the middle backrest portion. The middle portion of each of the left and right flexible cords 44 passes through and is guided by the respective rail 36 so as to divert movement of the respective flexible cord 44 from the upright direction to the longitudinal direction at the second end by pulling of the actuator 43, thereby stabilizing the movement of the left and right bolts 41 in the longitudinal direction.

Furthermore, the middle portions of the flexible cords 44 respectively have upright segments which are proximate to the respective first ends, and which are spaced apart from each other in the longitudinal direction. A crosspiece 37 extends in the longitudinal direction to bridge the upright segments of the flexible cords 44, and is disposed opposite to the actuator 43 in the upright direction. An anchored mount 38 is disposed on the inner surface of the middle backrest portion between the crosspiece 37 and the actuator 43. The biasing member 45 is a coiled spring which has a secured end secured to the crosspiece 37, and an anchoring end that is opposite to the secured end in the upright direction and that anchors the anchored mount 38 such that the crosspiece 37 is urged by the biasing member 45 to move downwards so as to bias the actuator 43 towards the lower position, and so as to bias the left and right bolts 41 toward the extended position. Thus, the actuator 43 is biased to abut against the outer surface of the middle backrest portion. Preferably, a barrier protrusion 39 is formed on and extends downwardly and rearwardly from the outer surface of the middle backrest portion, and is disposed at the other side of the actuator 43 relative to the biasing member 45 in the upright direction so as to prevent inadvertent contact with the actuator 43 by a child sitting on the chair.

Figure 4:
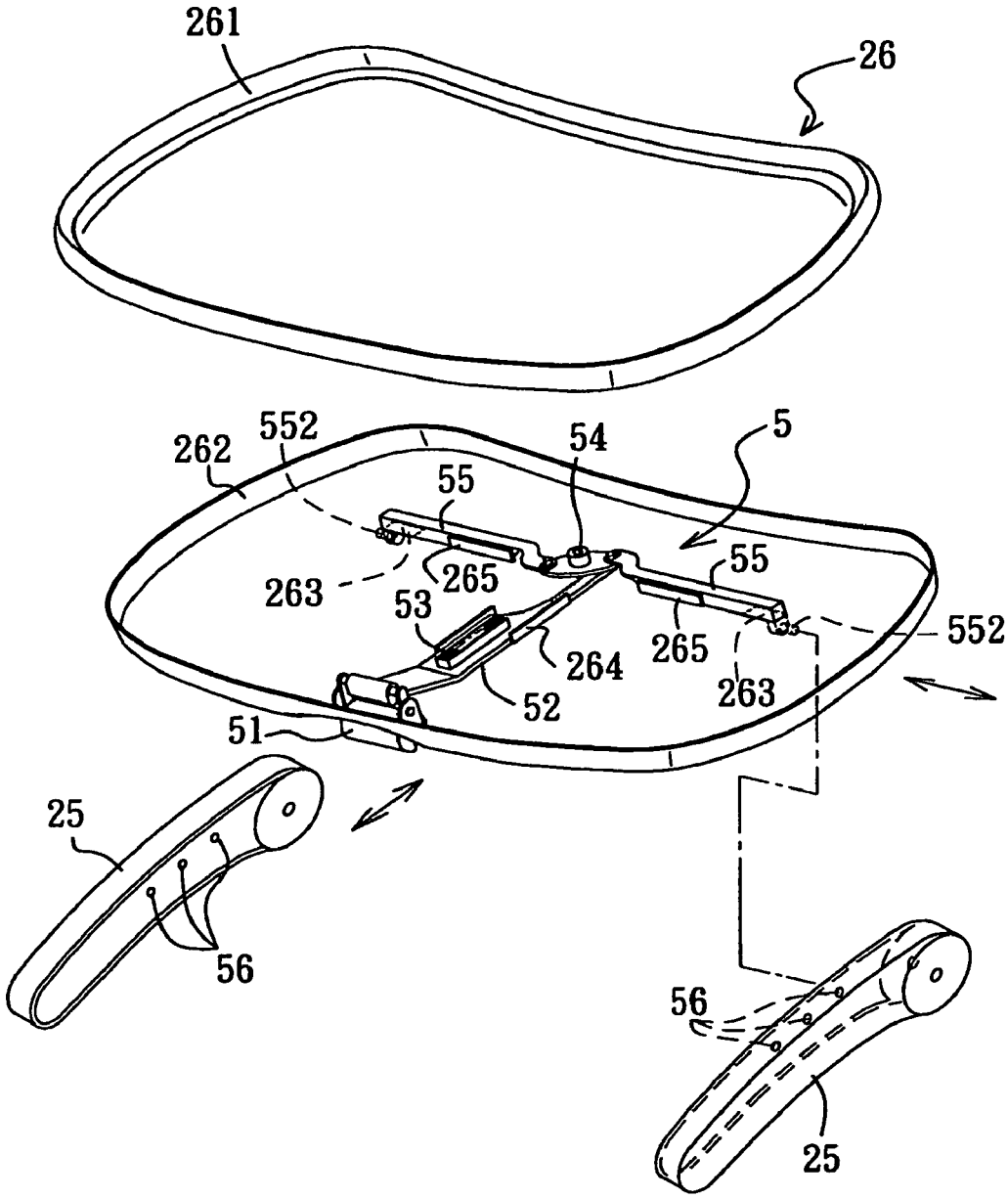
FIG. 4 is an exploded perspective view showing how a tray is mounted on a pair of armrests of the preferred embodiment.
Figure 5:
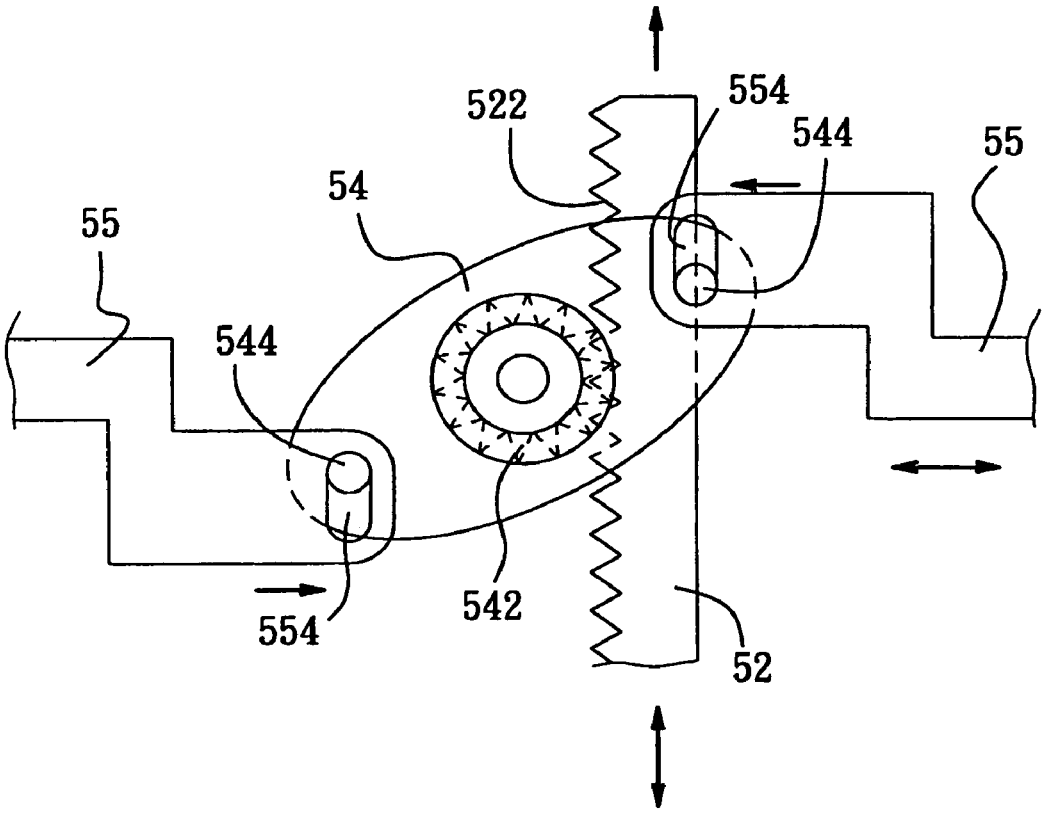
FIG. 5 is a schematic view showing an adjusting operation of a tray adjusting unit.
Figure 6:
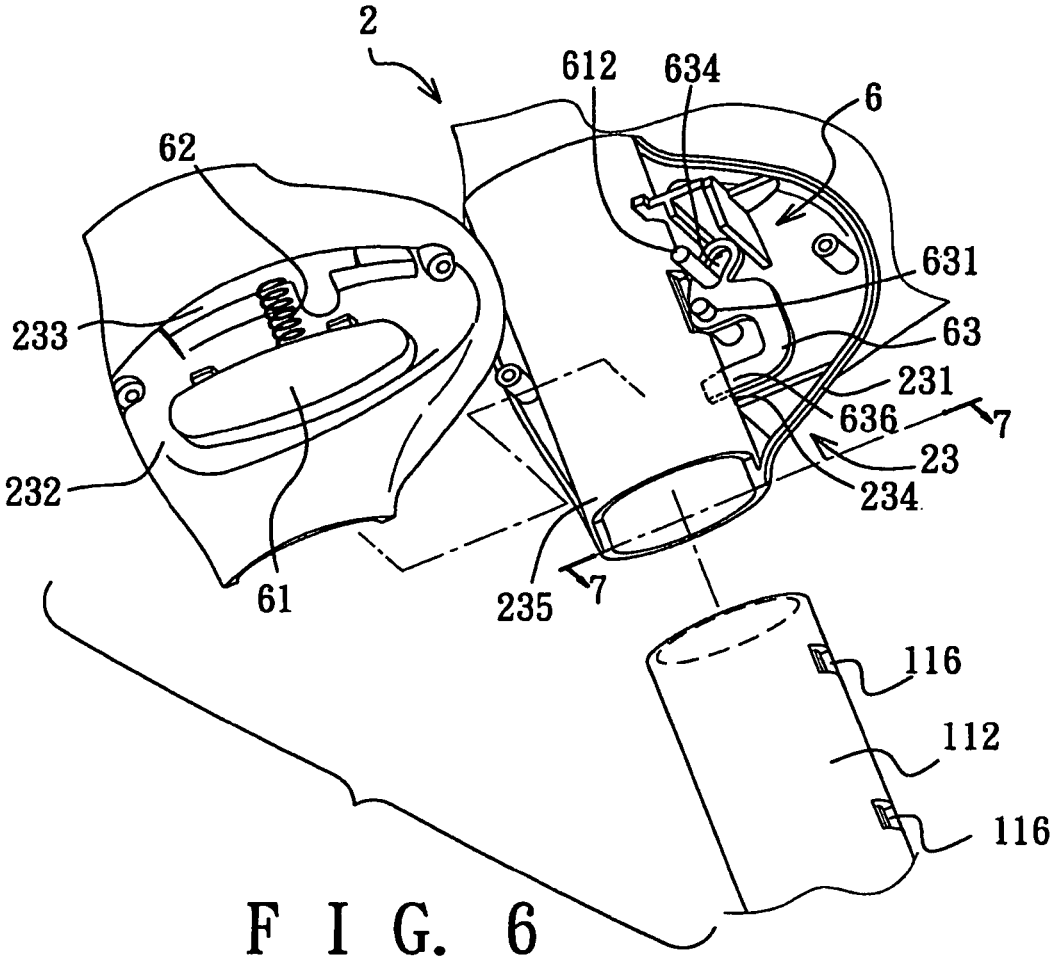
FIG. 6 is a fragmentary exploded perspective view of a height retaining unit disposed to retain a seat unit relative to a support leg of the preferred embodiment.
Figure 7:
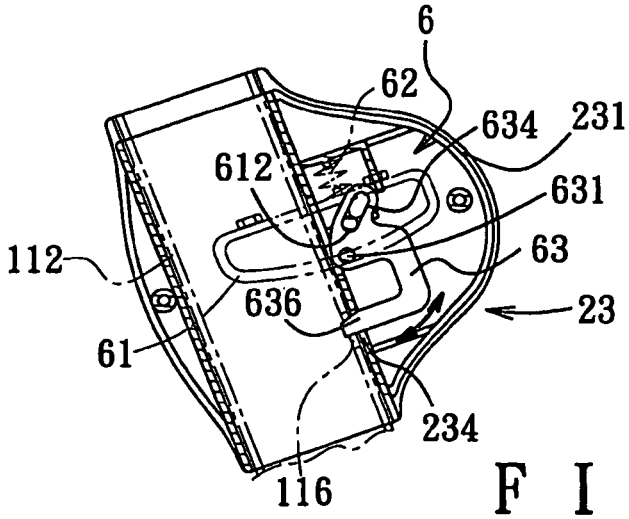
FIG. 7 is a fragmentary sectional view of the height retaining unit in an assembled state, taken along lines 7—7 of FIG. 6.

Moreover, referring to FIGS. 4 and 5, the tray 26 includes upper and lower halves 261,262 to define an accommodation chamber therebetween. A tray adjusting unit 5 is disposed in the accommodation chamber, and includes an operating member 51 which is pivotally mounted on a front end of the lower half 262, a transmitting member 52 which has an end coupled with the operating member 51 and which is guided by a rail 264 to be moved in the transverse direction when the operating member 51 is turned, and an opposite end provided with a rack 522 that meshes with a pinion 542 on a rotary member 54 so as to convert the movement of the transmitting member 52 into rotational movement of the rotary member 54, left and right bolts 55 which are guided by rails 265 disposed on the lower half 262 to be moved in the longitudinal direction, and which have inner ends coupled with two ends of the rotary member 54 by slots 554 and pins 544, and outer ends with latch portions 552 that extend outwardly of the lower half 262 through elongated holes 263 and in the longitudinal direction, and left and right sets of retaining holes 56 which are respectively formed in the left and right armrests 25. A biasing spring 53 is disposed on the transmitting member 52 and biases the operating member 51 to return to its original position. As such, the left and right bolts 55 can be moved close to each other in the longitudinal direction when the operating member 51 is rotated against biasing action of the biasing spring 53 such that the latch portions 552 disengage from the retaining holes 56 so as to permit sliding movement of the tray 26 relative to the left and right armrests 25 in the transverse direction. When the operating member 51 is released, the latch portions 552 can engage the selected ones of the retaining holes 56 to retain the tray 26 relative to the left and right armrests 25.

Furthermore, referring to FIGS. 1, 2, 6 and 7, each of the left and right secured members 23 of the seat unit 2 includes a mount seat 231 and a cover 232 to define an accommodation chamber therebetween. A sleeve tube 235 is disposed on the mount seat 231 and is slidably sleeved on each upright segment 112 of the front leg frame 11 so as to adjust the height of the seat unit 2 relative to the support leg 1. A height retaining unit 6 includes a push button 61, a biasing spring 62 and a retaining lever 63. The push button 61 is disposed on the cover 232, extends through a slot 233, and has an insert pin 612 disposed in the accommodation chamber. The biasing spring 62 is disposed to abut against the push button 61 and the cover 232. The retaining lever 63 is pivotally mounted on the mount seat 231 at a fulcrum 631, and has an elongated slot 634 and a retaining portion 636 which are disposed at two opposite ends of the fulcrum 631. The retaining portion 636 passes through a hole 234 in the sleeve tube 235 and engages a selected one of a plurality of retaining grooves 116 formed in the upright segment 112 so as to retain the seat unit 2 relative to the support leg 1. The insert pin 612 is inserted into the elongated slot 634 such that when the push button 61 is pushed into the slot 233 to move the insert pin 612 in the elongated slot 634 so as to turn the retaining lever 63 about the fulcrum 631 to thereby retract the retaining portion 636 from the retaining groove 116 and the hole 234, the sleeve tube 235 is permitted to slide along the upright segment 112

Figure 8:
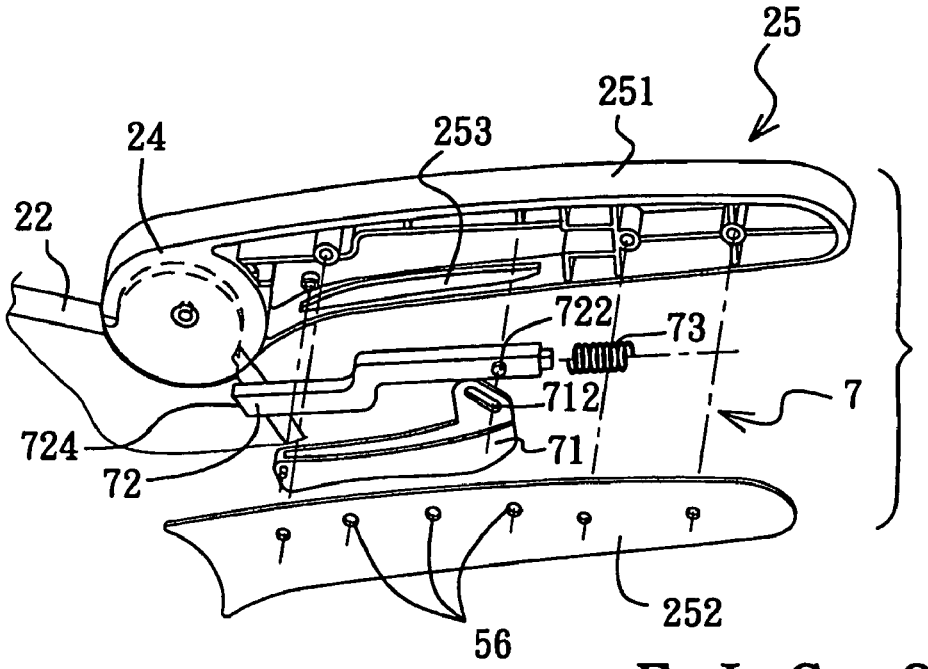
FIG. 8 is a fragmentary exploded perspective view of an armrest retaining unit for retaining an armrest relative to the seat unit of the preferred embodiment.
Figure 9:
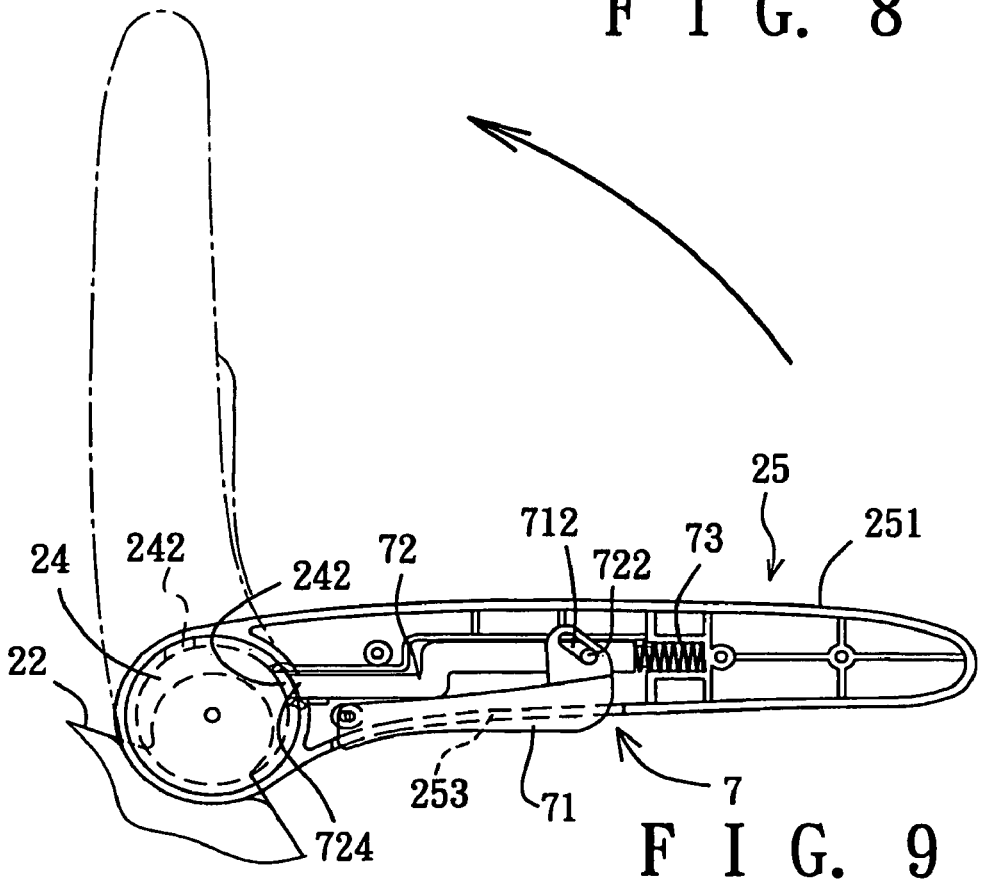
FIG. 9 is a schematic view showing the operation of the armrest retaining unit.
Figure 10:
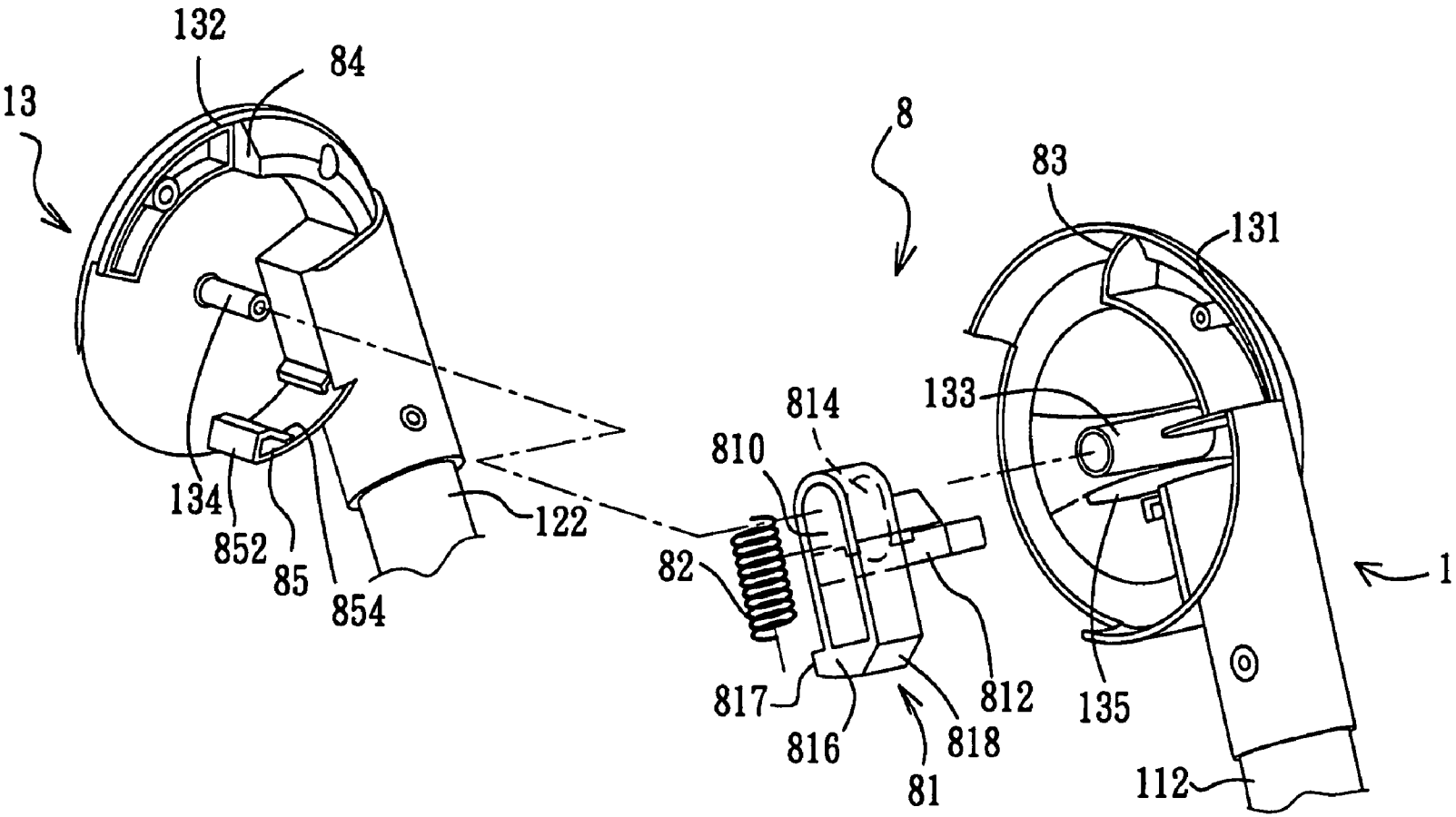
FIG. 10 is a fragmentary exploded perspective view of a coupling retaining unit for retaining front and rear leg frames of the support leg of the preferred embodiment.

Furthermore, referring to FIGS. 8 and 9, each of the left and right armrests 25 has a coupling end portion 24 which is pivotally mounted on the upper end of the respective one of the left and right side guarding members 22 so as to enable the respective armrest 25 to be turnable about a pivot axis in the longitudinal direction between a horizontal used position and an upright folded position. Each of the armrests 25 includes a mount seat 251 and a cover 252 to define an accommodation chamber therebetween. An armrest retaining unit 7 includes a pressing member 71, a moving bolt 72 and a biasing member 73. The pressing member 71 has a pivot end which is pivotally mounted on the mount seat 251, a coupling end which is coupled with an end of the moving bolt 72 by an elongated slot 712 and a pin 722, and a middle pressing portion which extends outwardly of the respective armrest 25 through an opening 253 and which is pressed to move the moving bolt 72 along the length of the armrest 25. The moving bolt 72 has an opposite end 724 which can engage a selected one of two retaining holes 242 that are formed in the coupling end portion 24 and that correspond with the horizontal used position and the upright folded position, respectively. As such, pressing of the middle pressing portion against the biasing action of the biasing member 73 results in movement of the moving bolt 72 away from the coupling end portion 24 to permit disengagement of the end 724 from any one of the retaining holes 242 so as to permit turning of the respective armrest 25 about the pivot axis.

Furthermore, referring to FIGS. 1, 2, 10 to 12, the coupler 13 includes first and second halves 131,132 which are respectively disposed on the upright segments 112,122 of the front and rear leg frames 11,12 and which are coupled rotatably with each other by an axle sleeve 133 and an axle shaft 134 extending in the longitudinal direction between unfolded and folded positions. To retain the front and rear leg frames 11,12 in one of the unfolded and folded positions, a coupling retaining unit 8 is provided and includes a retaining member 81, a biasing spring 82, first and second barrier portions 83, 84 which are respectively disposed on inner surfaces of the first and second halves 131,132 to abut against each other in the unfolded position, and a third barrier portion 85 which is disposed on the inner surface of the second half 132 and which is angularly displaced from the second barrier portion 84. The third barrier portion 85 has a leading barrier surface 852 and a slope-shaped trailing barrier surface 854. The retaining member 81 is disposed between the first and second halves 131,132, and has an operating portion 812 which extends outwardly of the coupler 13 through an opening 135, a passage 814 for passage of the axle sleeve 133 and the axle shaft 134, a receiving recess 810 for receiving the biasing spring 82, and a retaining portion 816 which has a leading barrier surface 817 and a slope-shaped trailing barrier surface 818. The biasing spring 82 abuts against the axle sleeve 133 and the retaining member 81 so as to bias the retaining member 81 away from the axle sleeve 133.

Figure 11:
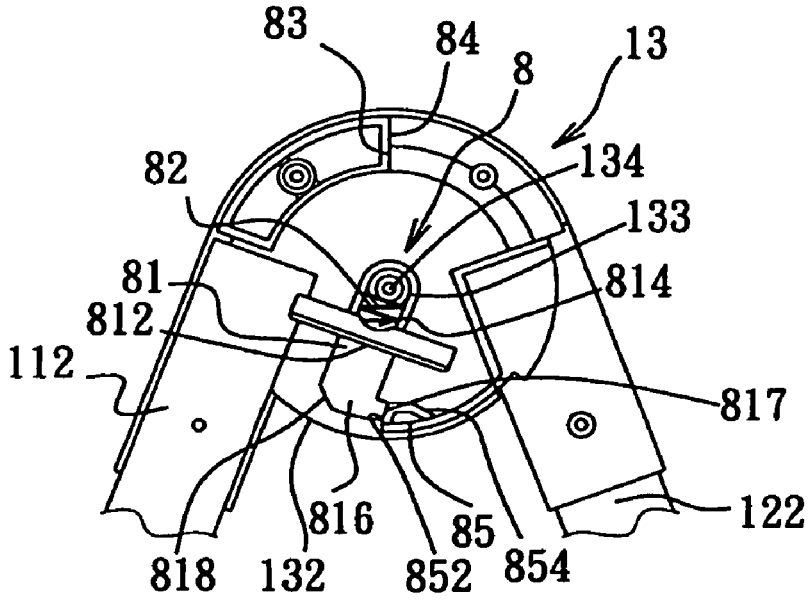
FIGS. 11 and 12 are schematic views showing the operation of the coupling retaining unit in unfolded and folded states, respectively.
Figure 12:
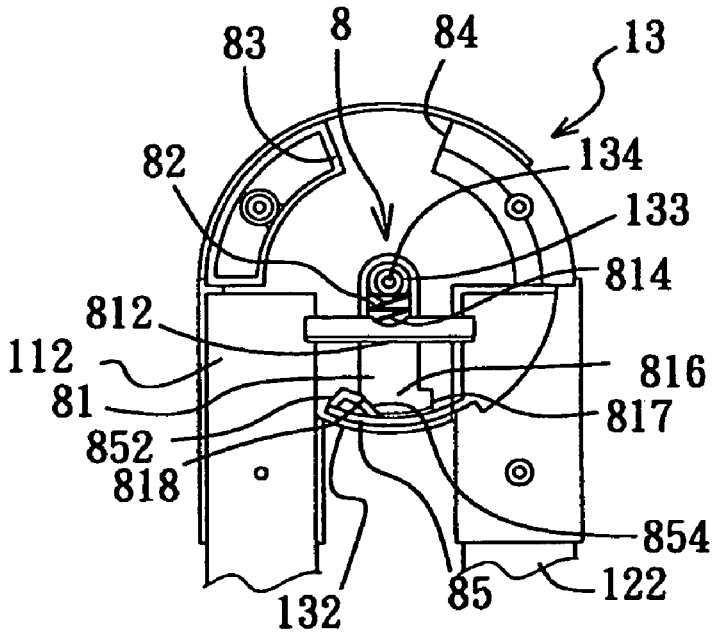

As such, when the front and rear leg frames 11,12 are in the unfolded position, as shown in FIG. 11, the first and second barrier portions 83,84 abut against each other to prevent further extension of the support leg 2, and the leading barrier surfaces 817,852 abut against each other to prevent collapsing of the support leg 2, thereby retaining the front and rear leg frames 11,12 in the unfolded position When the operating portion 812 is pressed against the biasing action of the biasing spring 82 so that the leading barrier surface 817 disengages from the leading barrier surface 852, the front and rear leg frames 11,12 can be turned to the folded position, as shown in FIG. 12. The operating portion 812 is then released such that the trailing barrier surfaces 818,854 abut against each other. Due to the slope shape of the trailing barrier surfaces 818, 854, the front and rear leg frames 11, 12 can be turned from the folded position to the unfolded position without pressing the operating portion 812.

As illustrated, in the child high chair of this invention, the backrest unit 3 can be adjusted and retained at a desired inclination angle relative to the seat body 21 by means of the releasably retaining unit 4, which has a simple construction. Besides, by means of the tray adjusting unit 5, the height retaining unit 6, the armrest retaining unit 7 and the coupling retaining unit 8, the tray 26, the seat unit 2, the armrests 25 and the support leg 2 can be adjustably retained at desired positions.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A child high chair comprising:

a support leg having a lower portion and an upper portion opposite to each other in an upright direction;

a mounting seat including left and right side guarding members which are opposite to each other in a longitudinal direction transverse to the upright direction and which are secured on said upper portion of said support leg;

a seat body which is disposed between said left and right side guarding members, and having front and rear seat portions opposite to each other in a transverse direction relative to both the longitudinal direction and the upright direction;

a backrest unit having left and right lateral ends which are opposite to each other in the longitudinal direction, and which are respectively inboard to said left and right side guarding members, and a middle backrest portion which is disposed between said left and right lateral ends and which has front and rear walls opposite to each other in the transverse direction, each of said left and right lateral ends being pivotally coupled to a respective one of said left and right side guarding members adjacent to said rear seat portion of said seat body to permit said backrest unit to turn about a pivot axis in the longitudinal direction;

a plurality of left retaining members which are in a form of a plurality of holes that are formed in said left guarding member, and which are angularly displaced from one another about the pivot axis, a plurality of right retaining members which are in a form of a plurality of holes that are formed in said right side guarding member, and which are angularly displaced from one another about the pivot axis;

a pair of bolts, each of which is disposed on and which is movable relative to a respective one of said left and right lateral ends in the longitudinal direction between an extended position, where a respective one of said bolts engages a selected one of said left and right retaining members so as to prevent turning of said backrest unit, and a retracted position, where the respective one of said bolts disengages from any one of said left and right retaining members so as to permit turning of said backrest unit about the pivot axis;

an actuator which is disposed on and which is movable relative to said rear wall of said middle backrest portion in the upright direction;

a pair of flexible members, each of which has a first end that is connected to said actuator, and a second end that is connected to a respective one of said bolts, and each of which is configured such that when said actuator is moved in the upright direction from a lower position to an upper position, said flexible members are pulled to move said bolts in the longitudinal direction from the extended position to the retracted position; and a biasing member disposed to bias said actuator toward the lower position.

2. The child high chair according to claim 1, further comprising left and right stabilizing members which are disposed on said rear wall of said middle backrest portion to stabilize movement of said bolts in the longitudinal direction.

3. The child high chair according to claim 2, wherein each of said flexible members is in form of a flexible cord which has a middle portion between said first and second ends, each of said left and right stabilizing members being in form of a rail and extending such that said middle portion of a respective one of said flexible cords passes through and is guided by said rail so as to divert movement of said flexible cord from the upright direction at said first end to the longitudinal direction at said second end.

4. The child high chair according to claim 3, wherein said middle portion of said flexible cord has an upright segment proximate to said first end, said upright segments of said flexible cords being disposed to be spaced apart from each other in the longitudinal direction, said child high chair further comprising a crosspiece which extends in the longitudinal direction to bridge said upright segments, and which is disposed opposite to said actuator in the upright direction such that said crosspiece is urged by said biasing member to move downwards, thereby biasing said actuator towards the lower position.

5. The child high chair according to claim 4, wherein said biasing member is a coiled spring having a secured end which is secured to said crosspiece, and an anchoring end which is disposed opposite to said secured end in the upright direction, said child high chair further comprising an anchored mount disposed on said rear wall of said middle backrest portion between said crosspiece and said actuator so as to be anchored by said anchoring end of said coiled spring.

6. The child high chair according to claim 1, wherein said rear wall of said middle backrest portion has inner and outer surfaces opposite to each other in the transverse direction, and a passage which extends from said inner surface through said outer surface, said flexible members being disposed on said inner surface, said passage being configured to permit extension of said first ends of said flexible members outwardly of said outer surface so as to bring said actuator to abut against said outer surface when said actuator is biased by said biasing member.

7. The child high chair according to claim 6, further comprising a barrier protrusion which is disposed above said actuator, and which extends downwardly and rearwardly from said outer surface of said middle backrest portion so as to prevent inadvertent contact with said actuator.

* * * * *